US005370099A

United States Patent [19]

Koelle et al.

[11] Patent Number: 5,370,099

[45] Date of Patent: Dec. 6, 1994

[54] IGNITION SYSTEM FOR INTERNAL COMBUSTION ENGINES

[75] Inventors: Ulrich Koelle, Schwieberdingen; Helmut Randoll, Tamm; Martin Streib, Vaihingen, all of Germany

[73] Assignee: Robert Bosch GmbH, Stuttgart, Germany

[21] Appl. No.: 227,902

[22] Filed: Apr. 15, 1994

Related U.S. Application Data

[63] Continuation of Ser. No. 972,495, filed as PCT/DE91/00571, Feb. 5, 1993, published as WO 92/03655, Mar. 5, 1992 abandoned.

[30] Foreign Application Priority Data

Aug. 24, 1990 [DE] Germany ..... 4026723

[51] Int. Cl.[5] ..... F02P 3/12

[52] U.S. Cl. ..... 123/603; 123/644

[58] Field of Search ..... 123/643, 644

[56] References Cited

U.S. PATENT DOCUMENTS

| | | | |
|---|---|---|---|
| 4,543,936 | 1/1985 | Gardner et al. | 123/475 |
| 4,773,380 | 9/1988 | Narita et al. | 123/644 |
| 4,889,094 | 12/1989 | Beyer et al. | 123/643 |
| 5,009,213 | 4/1991 | Di Nunzio | 123/643 |
| 5,027,785 | 7/1991 | Deutsch | 123/643 |
| 5,060,623 | 10/1991 | McCoy | 123/644 |
| 5,090,394 | 2/1992 | Bruckelt et al. | 123/643 |
| 5,107,817 | 4/1992 | Dittman et al. | 123/644 |
| 5,115,792 | 5/1992 | Fukui | 123/643 |
| 5,115,793 | 5/1992 | Giaccardi et al. | 123/644 |
| 5,134,987 | 8/1992 | Mayer et al.l. | 123/644 |
| 5,140,970 | 8/1992 | Akaki et al. | 123/644 |
| 5,150,697 | 9/1992 | Akagi et al. | 123/643 |
| 5,174,267 | 12/1992 | DeBiasi | 123/643 |
| 5,186,144 | 2/1993 | Fukui | 123/643 |
| 5,193,516 | 3/1993 | Zimmerman et al. | 123/643 |
| 5,199,405 | 4/1993 | Mukaihira et al. | 123/644 |

FOREIGN PATENT DOCUMENTS

| | | | |
|---|---|---|---|
| 0142817 | 5/1985 | European Pat. Off. | 123/643 |
| 57-059138 | 7/1982 | Japan | 123/643 |
| 2172115 | 9/1986 | United Kingdom | 123/643 |
| 8911591 | 11/1989 | WIPO | 123/643 |

*Primary Examiner*—Raymond A. Nelli
*Attorney, Agent, or Firm*—Michael J. Striker

[57] ABSTRACT

The ignition system for a four-cycle gasoline engine having at least one cylinder includes a spark plug for each cylinder and an ignition coil for each spark plug so that each spark plug has its own ignition coil with a primary and secondary side as well as a control device for controlling the timing of the firing of the spark plugs via the individual ignition coils according to a predetermined firing sequence connected to each of the ignition coils. To satisfy strict requirements regarding exhaust emission by monitoring operation of the individual cylinders while avoiding additional sensors, the control device includes a circuit for analyzing and storing the ignition voltages on the primary side of each ignition coil measured at a number of different times for successive ignition events in each cylinder and a comparator device which compares the dependencies of the ignition voltage on time for two successive ignition events and a phase signal generating device which produces a phase signal from the results of the comparison of the ignition voltages mmade by the comparator device for control of the fuel injection and spark timing for each cylinder.

7 Claims, 4 Drawing Sheets

IGNITION SYSTEM FOR INTERNAL COMBUSTION ENGINES

This application is a continuation of application Ser. No. 07/972,495, filed as PCT/DE91/00571, Feb. 5, 1993, published as WO 92/03655, Mar. 5, 1992, now abandoned.

BACKGROUND OF THE INVENTION

The present invention relates to an ignition system for internal combustion engines.

More particularly, it relates to an ignition system for a four-cycle gasoline engine with a static ignition distribution in which a spark plug, an ignition coil and a final stage of a control circuit of the ignition system for individual spark operation is associated with each cylinder. To satisfy the requirements governing harmful exhaust emissions, especially the strict requirements in the U.S., efforts have been made to develop ignition controls ensuring the lowest possible harmful emissions in four-cycle gasoline engines.

An ignition system which can be used for this purpose is known, for example, from the Japanese Patent 56-50263 A.

Methods for monitoring the operation of ignition systems are already known. For example, a method for obtaining the phase signal by means of a Hall sensor is described in DE-OS 36 34 587.

It is possible to detect ignition and explosion with the aid of a pressure sensor or optical sensor in the combustion chamber of every cylinder.

These known ignition controls have the disadvantage that additional sensors must be installed in the ignition system for monitoring operation. This makes the necessary signal detection very costly because of the cost of the sensors themselves on the one hand and because of the manufacturing costs for installing the sensors in the cylinders on the other hand. Moreover, the satisfactory functioning of these additional sensors must be monitored.

SUMMARY OF THE INVENTION

The ignition system for a four-cycle gasoline engine having at least one cylinder in which ignition events occur without use of a distributor device, includes a spark plug and an ignition coil electrically connected to the spark plug for each cylinder so that each spark plug has its own ignition coil having a primary side; and control circuit means connected with each ignition coil to control production of sparks in each cylinder to produce ignition events including means for measuring an ignition voltage of each ignition coil on the primary side of each ignition coil at a plurality of times to determine a dependence of that ignition voltage on time; means for evaluating the dependencies of the ignition voltages on time for each ignition event in each cylinder and means for generating a phase signal to detect a compression stroke after the engine is started including means for comparing two successive ignition events in each cylinder so as to produce the phase signal from the comparison of the two successive ignition events. has the advantage over known solutions that operation is monitored by detecting and evaluating the primary ignition voltage, i.e. no additional structural components are required in the engine compartment, especially sensors. Such a solution for monitoring operation without additional structural components such as Hall sensors or inductive sensors is substantially less costly.

The necessary evaluating electronics can be integrated in a device together with the control electronics.

A particular advantage consists in that a phase signal is obtained for detecting the compression stroke at each cylinder, which is the precondition for injection and/or ignition for each individual cylinder. This makes it possible to optimize the performance of the engine while simultaneously reducing wear on the ignition system and enables steps for active diagnosis of the cylinders.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

Embodiment examples of the invention are shown in the drawing and described in more detail in the following description.

DESCRIPTION OF THE PREFERRED EMBODIMENTS

Figure 1:
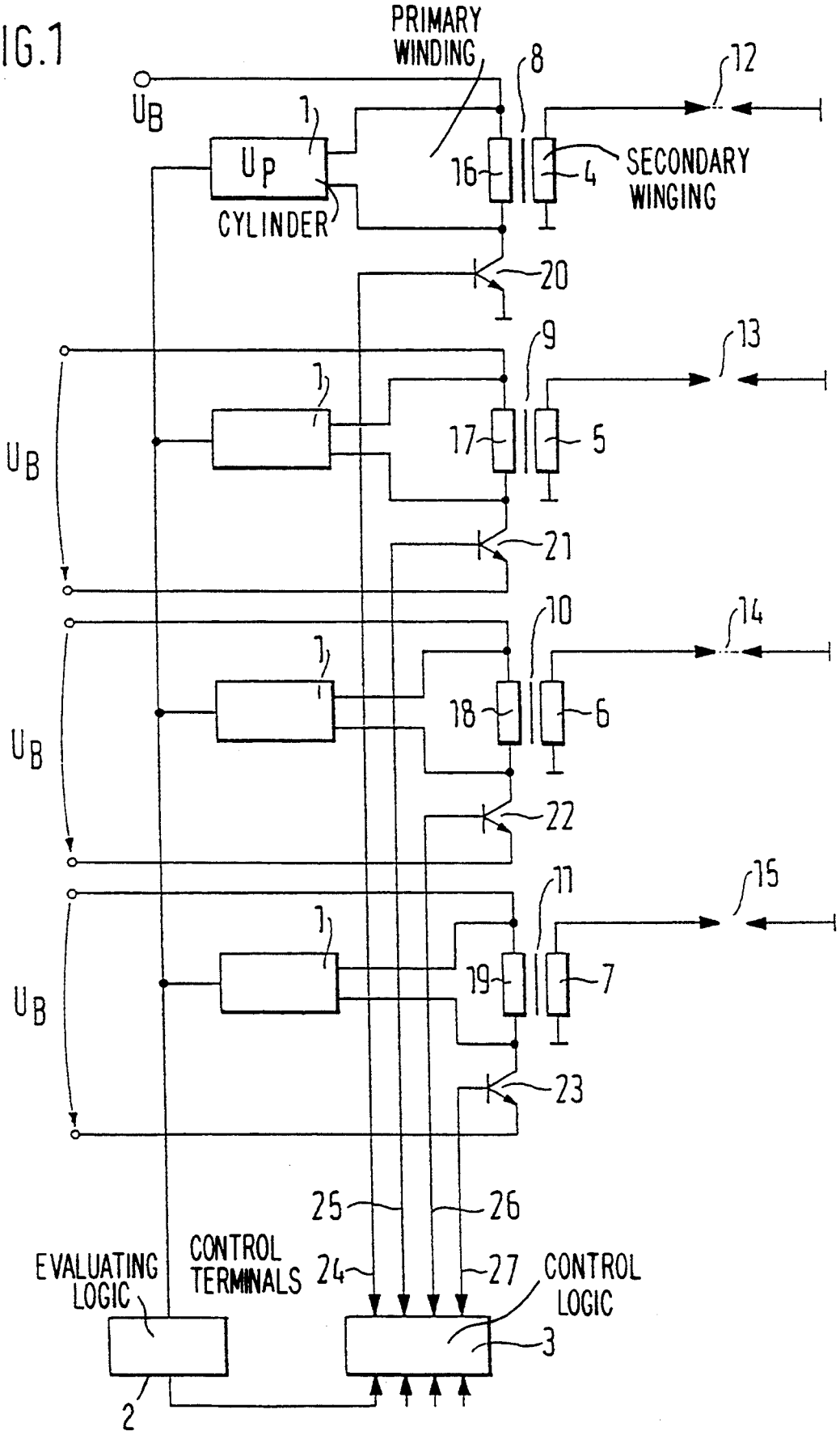
FIG. 1 is a block diagram of an ignition system with individual spark control and integrated evaluating logic.

The basic wiring diagram shown in FIG. 1 shows a circuit diagram for an ignition system of a four-cylinder four-cycle gasoline engine according to the invention having a primary voltage detection circuit 1 for each cylinder with the connected evaluating logic 2 for the individual ignition voltage curves.

Four secondary windings 4 to 7 of four ignition coils 8 to 11 are connected with their spark plugs 12 to 15. Each primary winding 16 to 19 of these individual ignition coils 8 to 11 is connected via an ignition transistor 20 to 23 to a voltage supply UB, e.g. to the battery of a motor vehicle, not shown in the drawing. The ignition transistors 20 to 23 are driven by a control logic 3 via control terminals 24 to 27 associated with them. The primary voltage curve Up for every cylinder is detected in a circuit 1 at the primary windings 16 to 19 and supplied to the common evaluating logic 2. The results determined in the evaluating logic are fed to the control logic 3 and, together with additional parameters such as crankshaft position, speed, suction pressure and the like, form the basis for driving the final ignition stages.

Figure 2:
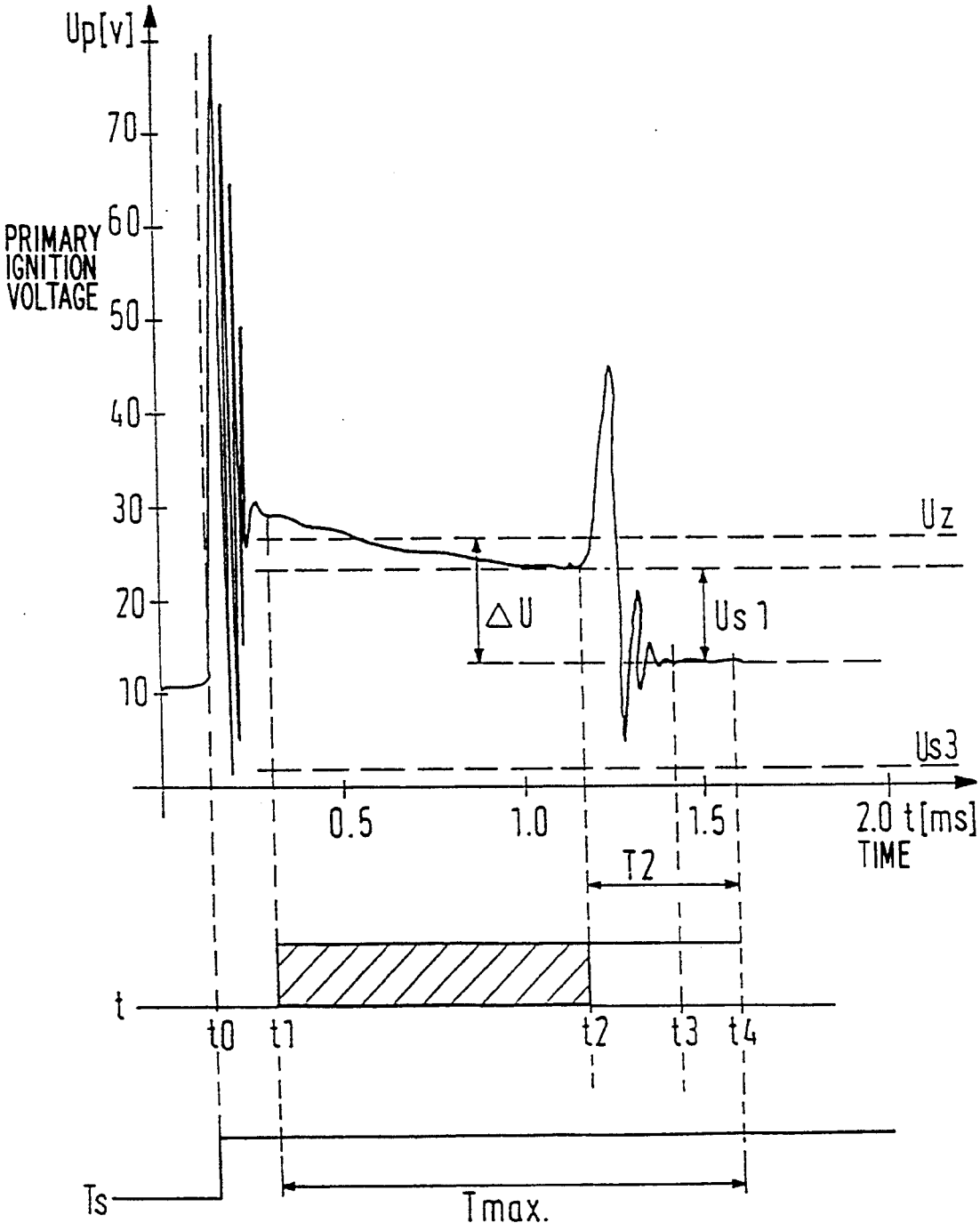
FIG. 2 is a graphical illustration of the dependence of the primary ignition voltage on time.

FIG. 2 shows the typical dependence of the primary ignition voltage Up at a predetermined speed on time for a regular ignition curve. The ignition signal begins at time t0 so that there is an overshoot of the primary voltage Up. Since this overshoot has no significance for the evaluation the evaluation first commences after a short time delay at time t1. The measurement window which is opened in this way remains effective until time t2. During this time the curve of the ignition spark combustion voltage at the spark plug on the primary side is detected and the average primary ignition voltage $$Uz = \frac{\int_{t1}^{t2} Updt}{t2 - t1}$$

is calculated from it. An error diagnosis, if necessary, can be effected via the curve of the primary combustion voltage. The measurement window remains open until time t4 although it is only effective until time t2. The voltage curve or overshoot of the primary voltage at the spark firing between times t2 and t3 is not significant for calculating the average voltage Uz and is therefore not detected. However, the primary ignition voltage after the spark firing up to time t4 is important. A voltage jump ΔU between Uz and the voltage Up at time t4 which exceeds a fixed comparison value Us1 (e.g. at least 10 V) signals the end of the spark and consequently the presence of a regular ignition spark.

Figure 3:
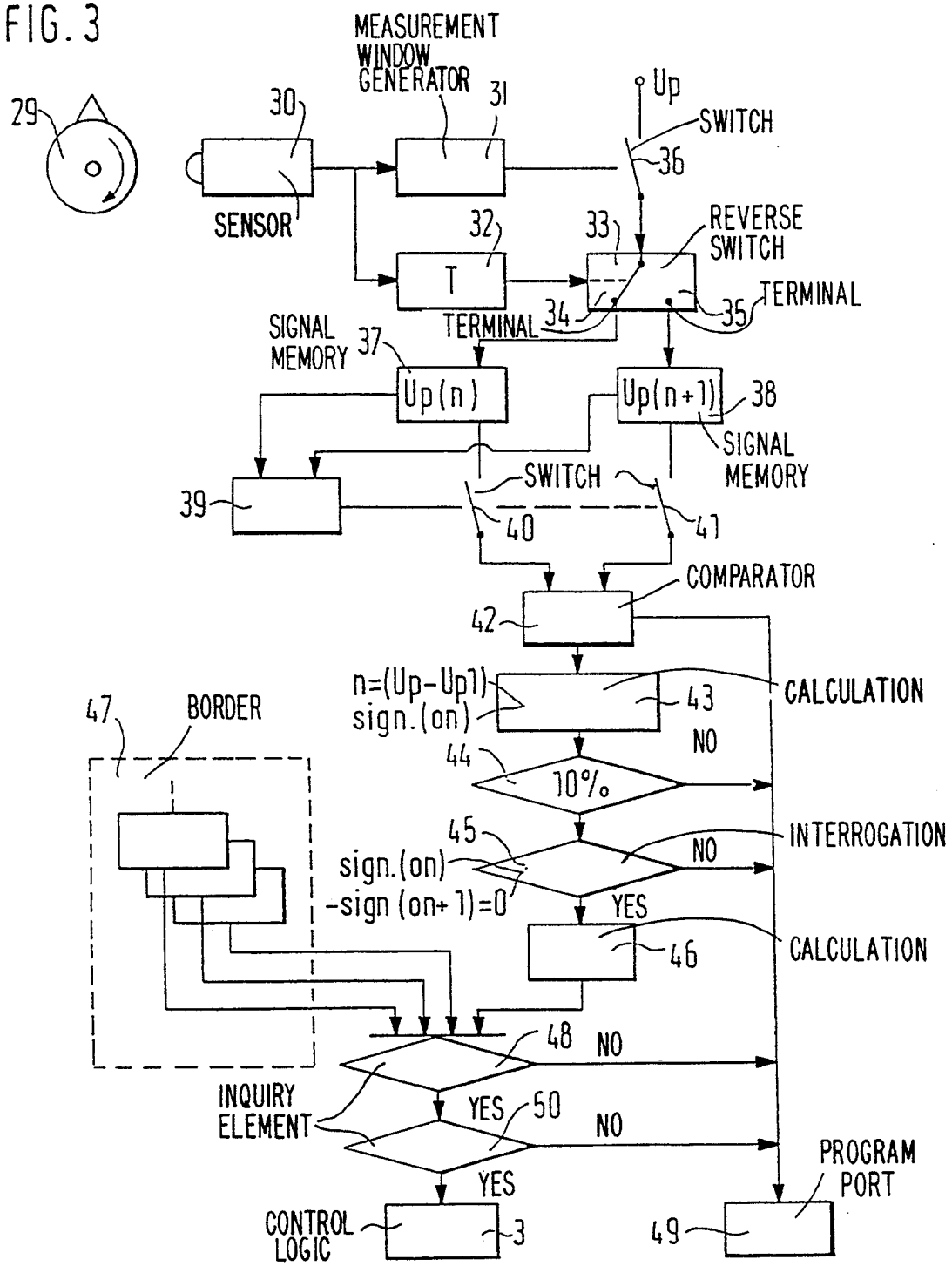
FIG. 3 is a flow chart of a program for a method of comparing two successive ignition events of a cylinder for obtaining the phase signal.

The circuit and program flow chart shown in FIG. 3 shows how the comparison of two successive ignition events of a cylinder, in this case cylinder 1, to be realized in the control logic 3 when the engine starts to run. By comparing the successive ignition processes, one of which occurs in the exhaust stroke of the cylinder and the other in the compression stroke, a phase signal for the detection of the compression stroke is to be determined first for subsequently stopping the ignition processes in the exhaust stroke and possibly controlling an injection of fuel for each cylinder in correct phase.

A circumferentially extending crankshaft mark 29 cooperates with a sensor 30 which is connected to a measurement window generator 31 on the one hand and via a time stage 32 to a reverse switch 33 on the other hand. The reverse switch 33 switches back and forth between two terminals 34 and 35 after every pulse. The primary voltage Up is connected via a switch 36, which is controlled by the measurement window generator 31, and the reverse switch 33 either to a first signal memory 37 via output terminal 34 or to a second signal memory 38 via output terminal 35. A counter 39 connected with the outputs of the signal memories 37, 38 controls a first switch 40 and a second switch 41. The two switches 40 and 41 connect the signal memories 37 and 38 with a program part 43 via a comparator 42. This program part 43 is connected via an inquiry element 44 with an additional inquiry element 45. A positive answer to these inquiry elements 44 and 45 means the detection 46 of a phase signal for the cylinder 1 as will be explained in the following. A border 47 in dashed lines symbolizes that this phase signal detection 46 is carried out analogously for all cylinders. An inquiry element 48 subsequently monitors the various phase signals. When there are a number of phase signals the plausibility of the phase signals must be checked in the inquiry element 50 with respect to the predetermined firing sequence. If the detected phase signals are plausible with respect to the firing sequence this is conveyed to the individual spark control at the control logic 3. The control logic 3 as a result activates the ignition transistors 20 to 23 so that they are conductive only in the compression stroke of the cylinders and that the injection can be effected in a selective manner with respect to the cylinders. The "NO" outputs of the inquiry elements 44, 45, 48 and 50 lead to program part 49 which erases the signal memories 37, 38 and restarts the phase detection.

The circuit and program diagram of FIG. 3 described above operates in the following manner. The crankshaft mark 29 triggers a pulse in the sensor 30 after every 360°. This pulse is transmitted to the measurement window generator 31 which opens a measurement window as a function of the crankshaft revolution for each cylinder after every 360° in an offset manner with respect to the angle of rotation, i.e. the switch 36 is closed and the primary voltage Up is connected to the reverse switch 33. This reverse switch 33 switches in a time-delayed manner after every pulse of the sensor 30 so that the switch 36 is then opened, from terminal 34 to 35 or vice versa. This causes the the primary voltage Up in a working cylinder as a function of time to be stored alternately in signal memories 37 and 38. The piston of a cylinder reaches the top dead center twice during a work cycle, namely between the exhaust stroke and intake stroke and between the compression stroke and work stroke. That is, the signal curves of the primary voltage are stored in one signal memory in the compression stroke and the signal curves in the exhaust stroke are stored in the other signal memory. To ensure reliable results, a determined quantity n (e.g. n=1–10) of signal curves are stored in the signal memories. If both memories 37 and 38 are full, the switches 40 and 41 are closed and a first comparison is carried out in the comparator 42. It is decided in the comparator 42 whether or not a significant difference exists. If not, the signal memory is erased in program part 49 and the signal detection is started again. If a significant difference is determined, this difference and the sign (Δn) are calculated in program part 43 according to the formula Δn=(Up−Up+1), i.e. the difference and the sign Δn between two successive signal curves are calculated and stored temporarily. Every time a new signal has been stored in one of the signal memories 37 and 38, the difference Δn and the sign (Δn) are recalculated in program part 43. Accordingly, the comparator 42 first calculates the difference Δn between the old signal of the compression stroke and the new signal of the exhaust stroke and next a Δ(n+1) between the signal of the following compression stroke and the signal of the exhaust stroke which has already been used once. A subsequent interrogation 44 checks whether or not this difference Δn exceeds a determined threshold. A minimum difference of the signal curves in the compression and exhaust strokes of at least 10% could be used. If this minimum difference exists, a phase signal can be determined for this cylinder. An interrogation 45 now checks whether the sign is different from Δn and Δ(n+1). If not, (sign Δn−sign(Δn+1)=0), a phase signal for the compression stroke detection for cylinder 1 is to be determined in program step 46, i.e. an assignment of the ignition to the compression stroke or exhaust stroke is effected from the different signal curves of the signals read into the memories 37, 38. The described program flow is carried out in all cylinders. If there is a negative answer in the inquiry elements 43, 45, 48 or 50 the signal detection begins again.

As soon as a phase signal occurs in the inquiry element 48 for at least two cylinders, these cylinders are checked in the inquiry element 50 for agreement with the predetermined firing sequence. If the phase signal sequence matches the firing sequence, the obtained phase signal is made use of in continued operation of the engine via the control logic 3 for each cylinder for controlling the final ignition stages for the individual spark operation of the ignition system in the compression stroke and for controlling the fuel supply for each cylinder, i.e. the ignition sparks are switched off in the exhaust stroke.

Figure 4:
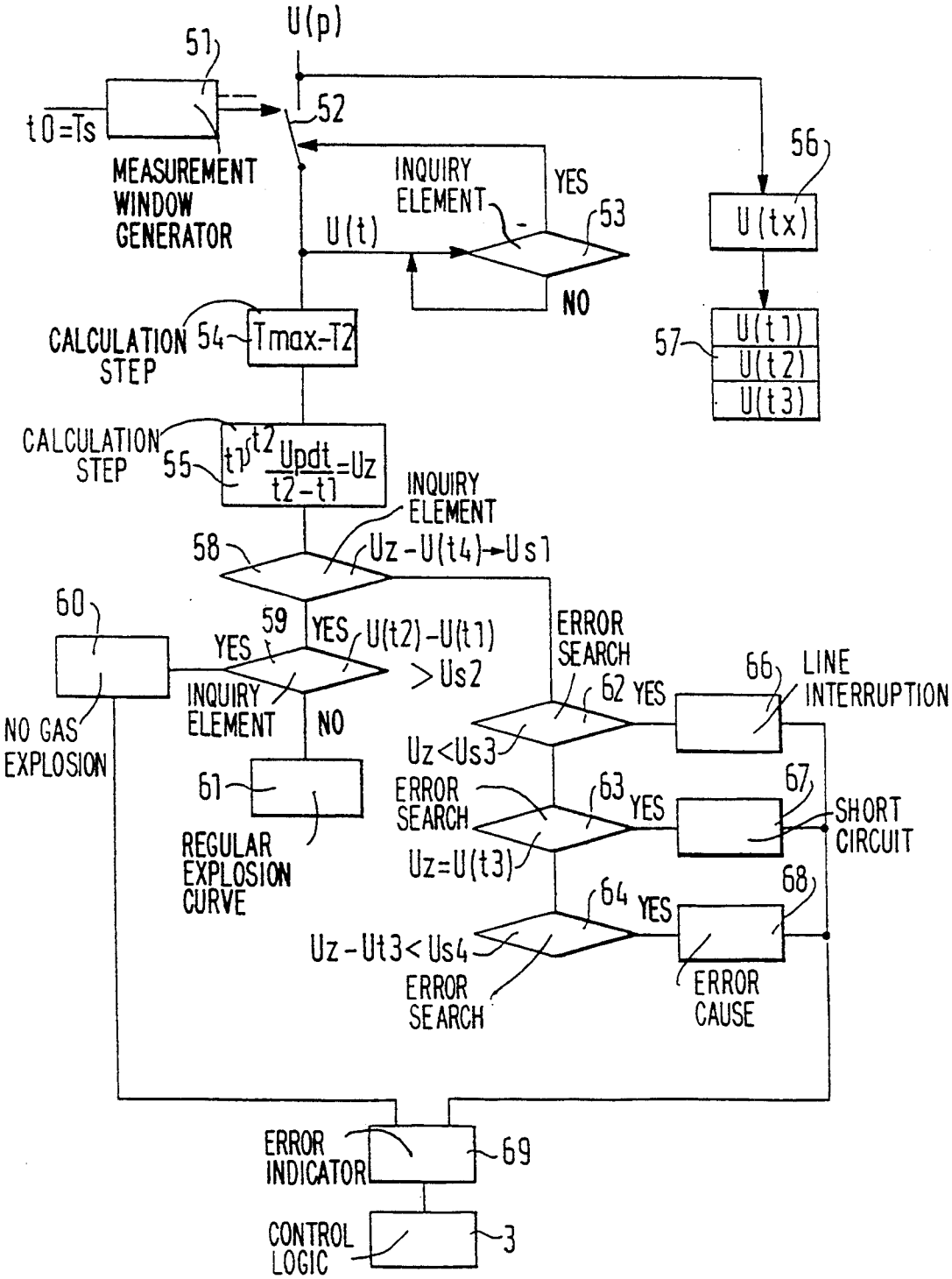
FIG. 4 is a flow chart of a program for a method for obtaining the ignition and explosion detection signal.

FIG. 4 shows a program flow diagram for detecting the ignition and explosion detection signal (ignition event diagnosis) which can be used when the engine is operating correctly for controlling the final ignition stages and during disturbances in determined cylinders for switching off the ignition and fuel supply to these cylinders.

According to FIG. 2, the ignition signal Ts begins at time to. After a short time delay, a measurement window generator 51 opens at time t1, i.e. it closes a switch 52. The delay is necessary for eliminating the overshoot of the primary voltage between to and t1. The switch 52 opens again when it is determined in the inquiry element 53 that $$\frac{U(t)}{dt}$$

is constant or, if this is not the case, after a time Tmax (approximately 2 ms). The time at which the measurement window is closed is time t4. However, as indicated in FIG. 1, the effective useful range of the measurement window is shorter by a time period T2 for eliminating the overshoot at the end of the spark. This useful range Tmax−T2 is calculated in program step 54. T2 includes the time period in which the overshoot occurs. After the effective measurement window time period t2−t1 is determined in the program step 55, the average primary ignition voltage $$Uz = \frac{\int_{t1}^{t2} Updt}{t2 - t1}$$

during this useful range is calculated. Parallel to this, momentary values of the voltage Up are detected in step 56 and stored temporarily in step 57.

After determining the average primary ignition voltage Uz the inquiry element 58 checks whether or not there is a voltage jump ΔU with respect to the average ignition voltage Uz at time t4. This voltage jump should have at least a value Us1 of 5 V during an ignition spark. Such comparison voltages Us1 to Us5 (as will be further explained in the following) are fixed comparison voltage values which are dependent on criteria regarding the engine status and are deposited in a memory of the evaluating logic 2.

If an ignition spark was detected, program step 59 checks whether or not the ignition spark also led to a gas explosion. For this purpose, the voltage values at the start t1 and at the end t2 of the ignition spark are compared in the inquiry element 59. If the difference between these two voltage values is greater than a comparison voltage Us2 (e.g. approximately 20 V), the ignition is effected in compression without supplying fuel, which means that no gas explosion was detected in program step 60. In the other case, a regular explosion curve is detected in program step 61. The information concerning the absence of a gas explosion—program step 60—is transmitted via an error indicator 69 to the control logic 3.

If no ignition spark could be detected in interrogation 58, the cause of the error is searched for in program steps 62, 63 and 64. Interrogation 62 checks whether or not the average ignition voltage Uz was less than a comparison voltage Us3 (e.g. 2 V); if this is the case, a line interruption is detected on the secondary side in program step 66. If the primary-side ignition voltage Uz is equal to the voltage value at time t3 (Uz=U(t3)), this indicates a short circuit on the primary side which is indicated in program step 67. There is a short circuit on the secondary side when the difference between the ignition voltage Uz and the voltage U(t3) is less than a comparison value Us4 (e.g. 5 V), (Uz−U(t3)<Us 4). The voltage values U(t1), U(t2) and U(t3) which are stored in the memory 57 are obtained in program step 56 by measuring the voltage at times t1, t2 and t3 and are retrieved from the memory as desired in the flow logic.

The information obtained in program steps 60, 66, 67 and 68 concerning the cause of the error is conveyed to the error indicator 69 and leads to the corresponding measures in the control logic 3, e.g. switching off the defective cylinder. The comparison voltages mentioned above are to be determined for each type of vehicle and correspondingly stored in the control logic. These comparison values were determined on a test stand for one vehicle and are e.g. Us1=10 V, Us2=20 V, Us3=2 V and Us4=5 V.

This flow logic of the ignition event diagnosis is applied for all cylinders. If an error has been determined in a cylinder, an error indicator is actuated and the injection and ignition at the corresponding cylinder is shut off to prevent an impermissible harmful emission.

When an erroneous ignition signal is detected, the ignition can be switched on at periodic intervals without injection to test whether or not the ignition is functioning again (e.g. by free burning of the spark plug). If a regular ignition spark reappears, the injection can be switched on again.

To ensure that signals are obtained in a reliable manner the method described with reference to FIG. 4 can also be combined with other methods and systems for diagnosing ignition events (e.g. detecting hunting of the crankshaft). This is particularly advisable when it is impossible to reliably detect an absent gas explosion in all operating points of an engine.

It will be understood that each of the elements described above, or two or more together, may also find a useful application in other types of constructions differing from the types described above.

While the invention has been illustrated and described as embodied in an ignition system for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An ignition system for a four-cycle gasoline engine having at least one cylinder in which ignition events occur, said ignition system comprising a spark plug and an ignition coil electrically connected to said spark plug associated with and connected to each of said cylinders so that each of said spark plugs is connected to a different one of said ignition coils, each of said ignition coils having a primary side; and control circuit means connected with each of said ignition coils to control production of said sparks in said at least one cylinder to produce said ignition events including means for measuring an ignition voltage of each of said ignition coils on said primary side of each of said ignition coils at a plurality of times to determine a dependence of said ignition voltage of each of said ignition coils on time; means for evaluating said dependencies of said ignition voltages on time for each ignition event in said at least one cylinder and means for generating a phase signal to detect a compression stroke after said engine is started including means for comparing two successive ignition events in said at least one cylinder.

2. An ignition system as defined in claim 1, wherein said means for comparing compares an exhaust stroke and a compression stroke.

3. An ignition system as defined in claim 1 wherein said control means includes means for using said phase signal during a continued operation of the engine for each of said cylinders to control the making of said spark in each of said cylinders, and to control injection of a fuel into each of said cylinders.

4. An ignition system as defined in claim 1 wherein said means for evaluating includes means for generating an explosion detection signal for each of said ignition events in said at least one cylinder including means for comparing ignition voltage values for said ignition voltages measured at said primary side of one of said ignition coils of said at least one cylinder at a plurality of different times with standard ignition voltage values of a standard explosion event in said at least one cylinder; and memory means for storing the explosion detection signal.

5. An ignition system as defined in claim 4, wherein said means for evaluating includes means for analyzing said explosion detection signal to detect defective cylinder operation and means for switching off a defective one of said at least one cylinders detected by said means for analyzing.

6. An ignition system as defined in claim 5, wherein said means for evaluating includes means for generating said sparks in said defective cylinder after switching off said defective cylinder and means for switching on said defective cylinder again when a regular ignition event occurs therein.

7. An ignition system as defined in claim 1; and further comprising additional monitoring systems for monitoring operation of said at least one cylinder.

* * * * *